United States Patent [19]

Faurholdt

[11] 4,419,943

[45] Dec. 13, 1983

[54] INCINERATOR FOR CHEMICAL WASTE MATERIAL STORED IN BARRELS

[76] Inventor: Bent Faurholdt, Hφjvaenget 8, Helsingφr DK-3000, Denmark

[21] Appl. No.: 387,872

[22] PCT Filed: Oct. 28, 1981

[86] PCT No.: PCT/DK81/00095

§ 371 Date: Jun. 9, 1982

§ 102(e) Date: Jun. 9, 1982

[87] PCT Pub. No.: WO82/01581

PCT Pub. Date: May 13, 1982

[30] Foreign Application Priority Data

Oct. 29, 1980 [DK] Denmark ..... 4590/80

[51] Int. Cl.[3] ..... F23G 7/00

[52] U.S. Cl. ..... 110/237; 110/235; 110/255

[58] Field of Search ..... 110/235, 237, 346, 255; 432/52

[56] References Cited

U.S. PATENT DOCUMENTS 2,822,160 2/1958 Walpole .
3,670,667 6/1972 Faurholdt .
3,922,974 12/1975 Hempelmann ..... 110/237
4,136,624 1/1979 Kato et al. .
4,332,626 6/1982 Hood et al. ..... 110/236

*Primary Examiner*—Edward G. Favors
*Attorney, Agent, or Firm*—Watson, Cole, Grindle & Watson

[57] ABSTRACT

Incinerator having a primary and a secondary combustion chamber, the primary combustion chamber has a bottom section and a top section, both provided with burners and air injection devices. The wall of the top section has a sluice port for introducing a barrel, and within the top section there is provided a barrel holder for receiving and holding such a barrel. The barrel holder is mounted for rotation about a horizontal axis and can be operated for turning the barrel from upright to fully or partly inverted position and vice versa. Burning of the waste may take place either in the barrel in upright position, or upon turning of the barrel and dropping of its contents into the bottom section, or a combination of both. Thereby optimum conditions may be created for incineration of waste of varying consistency, ranging from liquid to solid, and no manual handling of barrels or their contents is required. A maximum of automatization and economy can be obtained by providing, in the top section, a downwardly directed, vertically displaceable burner combined with a consistency sensor assisting in governing displacement of the burner and turning of the barrel holder.

4 Claims, 5 Drawing Figures

INCINERATOR FOR CHEMICAL WASTE MATERIAL STORED IN BARRELS

BACKGROUND OF THE INVENTION

This invention relates to an incinerator for chemical waste material stored in barrels. In many factories and enterprises within the chemical field it is very difficult and expensive to dispose of the chemical waste material resulting from the operation in a manner harmless to the environment, even where the waste in question is in itself suitable for complete combustion without giving rise to air pollution. More particularly, the waste material in question is such which arises from various forms of chemical activities and is stored in barrels, generally of a size of 200 l. The waste material is frequently not pumpable, but has a high viscous or tough consistency or is in a solid state. The chemical waste may, however, also be in entirely liquid form. The taking-out of such waste material from the barrels prior to disposal may involve considerable environmental risks for the persons who handle the waste.

Illustrative of waste which can be incinerated by the present invention is waste resulting from the production of lacquer and varnish. Examples of such waste are phenol lacquer comprising phenol, formaldehyde, cresol, xylene, i-butanol, methanol or peramine lacquer (composed of formaldehyde, urea, ethanol, i-butanol) or melamine lacquer (comprising formaldehyde, melamine, water) or epoxy lacquer (comprising epoxy resin, methanol, methyloxitol, acetone, tetrabromobisphenol A, dimethylformamide). Besides, a number of solvents occur in connection with these types of waste.

Incinerators for chemical waste material are known which comprise a primary combustion chamber with an outlet connected to a secondary combustion chamber, in which the combustion of gases and flying particles from the primary combustion chamber is completed. An example of such an incinerator is disclosed in U.S. Pat. No. 3,670,667.

It is the object of the invention to construct the primary combustion chamber and associated equipment of an incinerator of the kind referred to in such a manner that it is capable of receiving the chemical waste material in the barrels, in which it is stored and to effect incineration under optimum conditions irrespectively of the consistency of the waste material within the full range from liquid to solid.

SUMMARY OF THE INVENTION

According to the invention, in an incinerator of the kind referred to, the primary combustion chamber has a bottom section suitable for the combustion of solid waste material and a top section provided with a lateral port with a sluice closure and associated means for introducing a barrel through the port into the top section and withdrawing it therefrom, a barrel holder being provided in the top section in level with the lateral port, the barrel holder being adapted to receive and hold a barrel introduced through the port and being mounted for rotation about a horizontal axis for the purpose of turning a barrel held by it from upright to fully or partly inverted position and vice versa, burners and air injection means being provided for supplying flame heat and air both to the bottom section of the primary combustion chamber and to the interior of a barrel standing upright in the barrel holder.

In an incinerator constructed in this manner, incineration will be initiated as soon as a barrel has been introduced into the top section of the combustion chamber and is standing in upright position in the barrel holder. If the waste material is in a liquid state, incineration in this manner may proceed until practically the whole content of the barrel has been burnt, and the barrel may then be turned in its holder to fully or partly inverted position to drop any residual waste material and/or any ashes into the bottom section of the combustion chamber, where residual waste material will be burnt in conventional manner. If the waste material is solid or of tough consistency, the initial stage of the incineration will mainly serve to burn the waste material loose from the wall of the barrel so that practically the whole content of the barrel may then be dropped into the bottom section of the combustion chamber by turning of the barrel holder as described. It will be realized that owing to the arrangement described there is no necessity of manually handling the barrels during their travel from a point of storage to the incinerator, into and out of the primary combustion chamber and finally to a point of delivery of the empty barrels now completely devoid of contaminating matter.

In a preferred embodiment of the invention, a downwardly directed burner is provided in the top section of the combustion chamber above the location of the holder, the burner being vertically displaceable from a position above the open top of a barrel held in upright position in the holder to a position adjacent the bottom of such barrel, the burner being combined with air injection means for injecting air into the barrel during the lowering of the burner therein, and with a sensor with associated control means adapted upon sensing a hard surface of the content of the barrel to initiate withdrawal of the displaceable burner from the barrel and subsequent turning of the barrel held in the holder from upright position to fully or partly inverted position.

By this arrangement the operation of the incinerator may be fully automatized for obtaining optimum conditions of incineration of chemical waste material of a consistency varying from barrel to barrel.

The invention will now be further described with reference to the accompanying drawings, the figures of which are all diagrammatical, though with different degrees of detail.

DETAILED DESCRIPTION OF THE PREFERRED EMBODIMENTS

Figure 1:
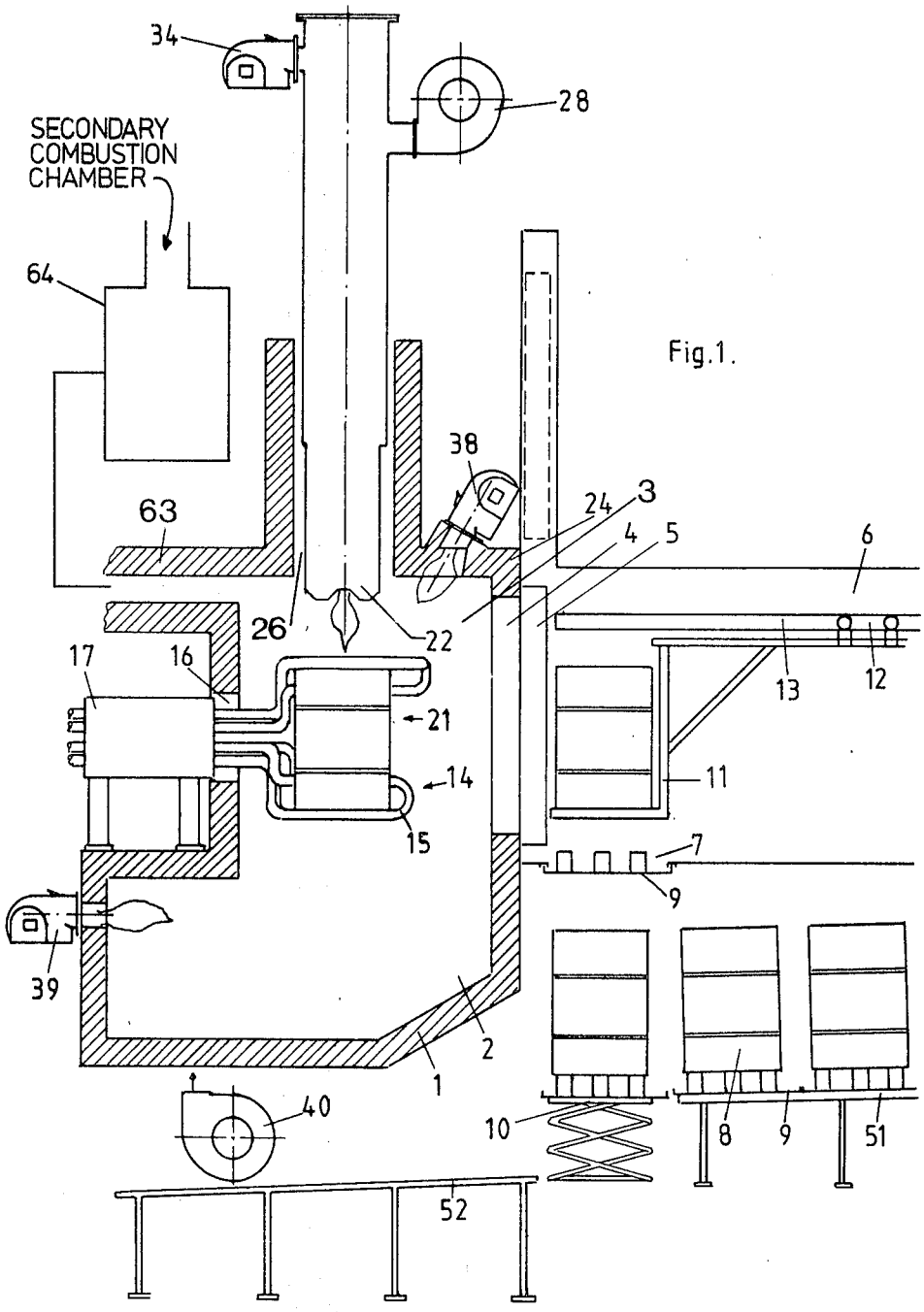
FIG. 1 is a vertical section through an incinerator according to one embodiment of the invention.

In the drawings, 1 is an incinerator having a primary combustion chamber 2, 3. This is provided at its top with an outlet passage 63 leading to a secondary combustion chamber, diagrammatically illustrated at 64 which may advantageously be thermally separated from the primary combustion chamber and may, e.g., be constructed as disclosed in U.S. Pat. No. 3,670,667. The arrangement of the secondary combustion chamber does not form part of the invention.

The primary combustion chamber has a bottom section 2 of a size sufficient for receiving and burning the content of a barrel in solid state. Above the bottom section the combustion chamber has a top section 3 in which there is provided a lateral port 4 adapted to be closed by means of a vertically slidable gate 5 separating the combustion chamber from a sluice chamber 6 which has a bottom opening 7.

Under the sluice chamber there is illustrated a roller conveyor 51 which conveys barrels 8 standing on pallets 9 to an elevator 10 located directly below the bottom opening 7 of the sluice chamber 7. When a barrel has arrived on the elevator 10, this can lift the barrel up through the opening 7 and into the sluice chamber 6 until the pallet strikes the bottom of the sluice chamber and thereby engages the edge of the opening 7 to form a closure. In the sluice chamber there is mounted a lifting and conveying fork 11, which by means of rollers 12 is rollably suspended from a guide rail 13 and is operable in such a manner that it can lift a barrel 8 introduced into the sluice chamber 7 from its pallet 9 and then push it in through the port 4 after the gate 5 has been lifted.

Inside the combustion chamber a barrel holder is mounted in alignment with the port 4. The barrel holder is in the form of a cage formed by cooling pipes 15 which are extended out of an opening 16 of the wall of the combustion chamber and outside the latter are connected with a drum-shaped hub member 17 which is rotatably mounted in bearings and is sealed against the opening 16 by means of a sealing member 20. The barrel holder is thereby rotatable about a horizontal axis. During operation it is cooled by means of liquid supplied to the pipes 15 in any suitable manner, not illustrated, for circulation therein.

Figure 2:
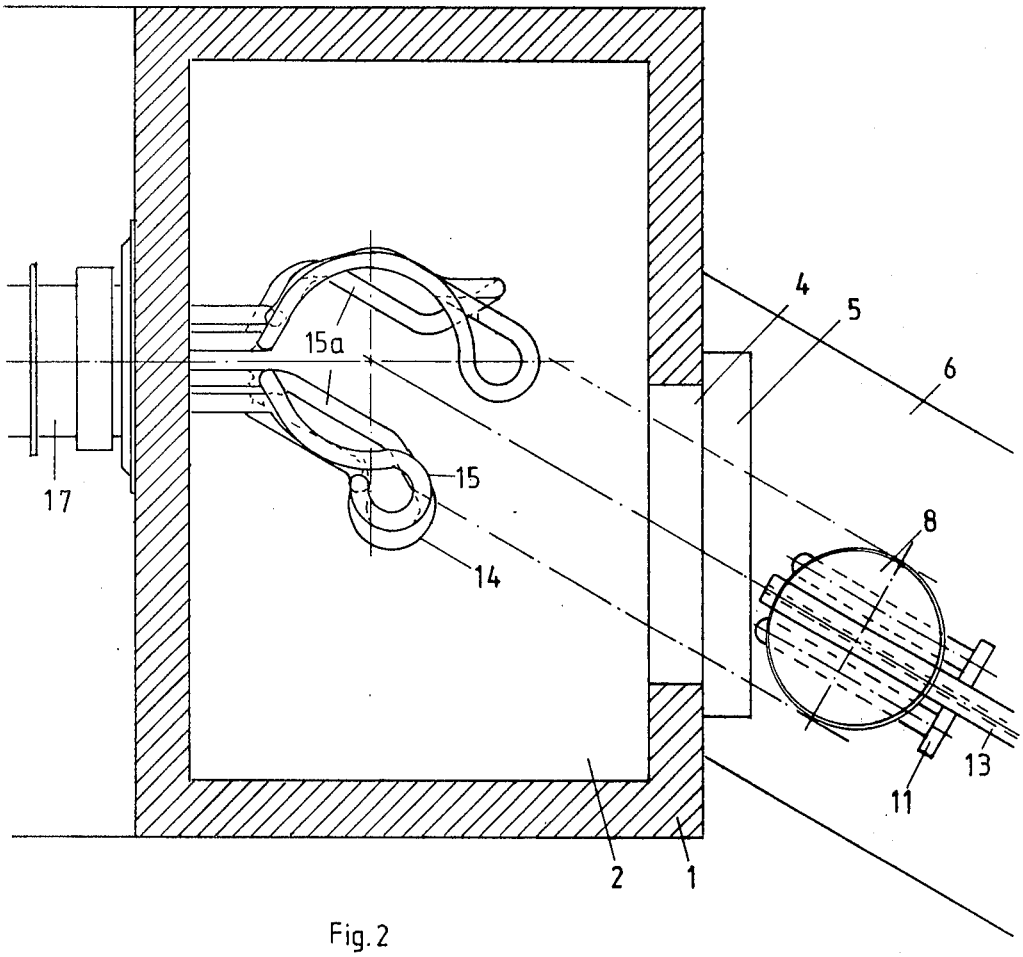
FIG. 2 is a horizontal section through same.
Figure 3:
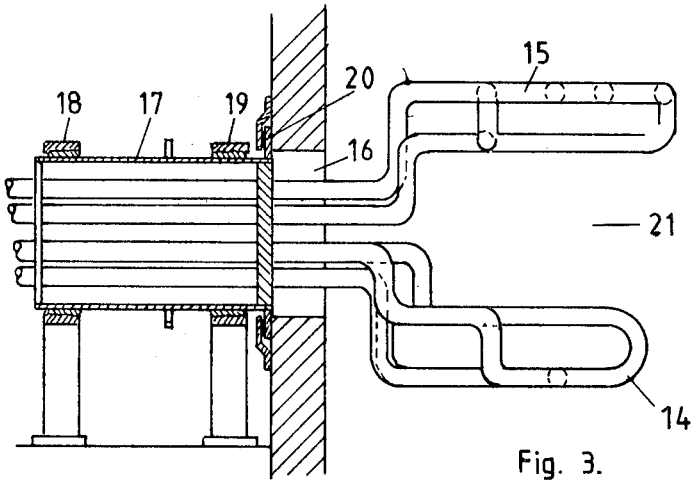
FIG. 3 shows, on a larger scale, the mounting of a barrel holder in the primary combustion chamber of the incinerator, as seen in vertical section.
Figure 4:
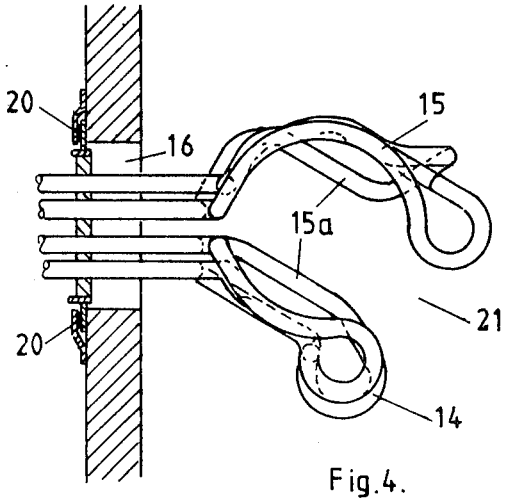
FIG. 4 is a corresponding horizontal section.

The cage forming the barrel holder 14 has a gap 21 through which a barrel standing on the lifting and conveying fork 11 can be introduced into the cage and can then by lowering and withdrawal of the fork be left behind on pipes 15*a* forming the bottom of the cage. In FIG. 1 the gap 21 is for simplicity of illustration shown as being directed coaxially with the axis of rotation of the barrel holder, and the same therefore applies to the port 4 of the combustion chamber and the sluice chamber 6 with the guide rail 13 for the lifting and conveying fork 11. It is, however, more practical, as illustrated in FIG. 2, to arrange the gap 21, the port 4 and the sluice chamber 6 along an axis inclined in a horizontal plane with respect to the axis of rotation of the barrel holder 14. Thereby it becomes possible in a simple manner by a suitably assymmetric construction of the pipes of the cage to obtain that a barrel standing in the cage is reliably detained against dropping out when the cage is turned 180° in one direction, while in the case of turning the cage in the opposite direction the barrel commences to slide out of the cage already after a turning angle of 90°.

Above the barrel holder there is mounted a burner unit 22 with associated air injection means, in the following referred to as the barrel burner. Further burners and air injection nozzles with associated blowers are provided at suitable locations and in a suitable number, including burners 38 (one of which is shown in FIG. 1) directed downwards at an inclination towards the outer surface of a barrel standing in the barrel holder, at least one burner 39 in the bottom section 2 of the combustion chamber, and a diagrammatically indicated blower 40 for the injection of air into the bottom section.

Figure 5:
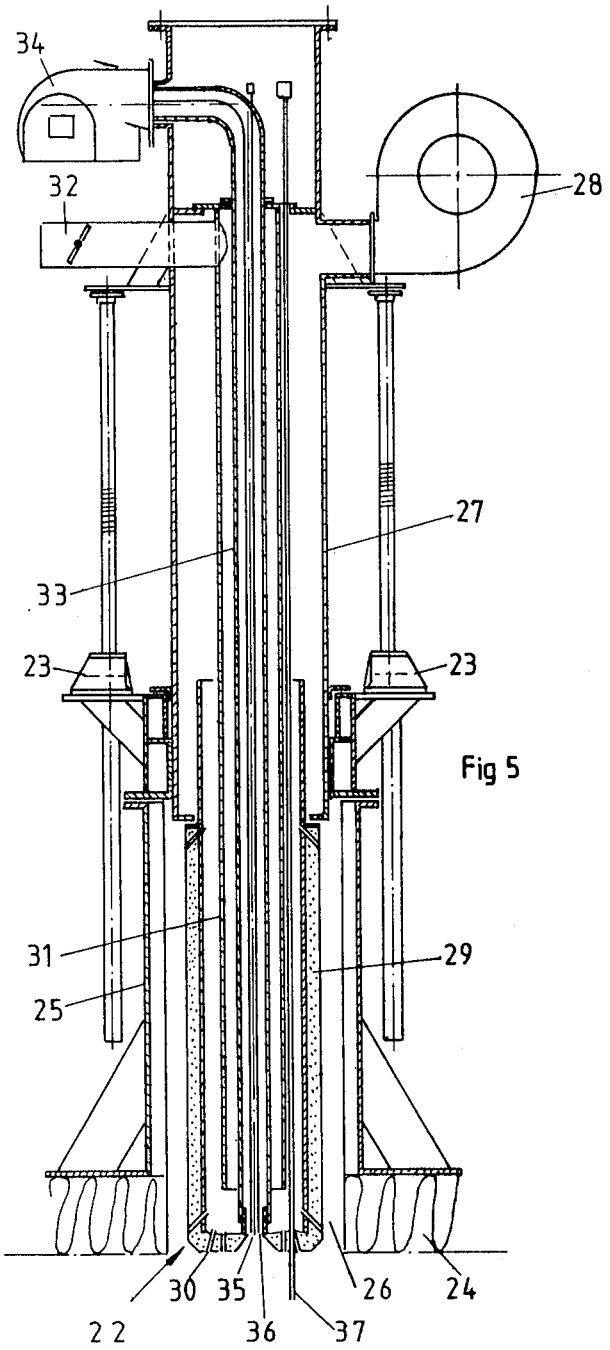
FIG. 5 shows a preferred form of a burner mounted at the top of the primary combustion chamber, as seen in vertical section.

A preferred constructional form of the barrel burner 22 is shown in FIG. 5. In this embodiment, the barrel burner is vertically displaceably mounted in spindle feed guides 23 carried by a frame 25 mounted on top of the upper wall 24 of the combustion chamber 2, 3. The barrel burner extends through an opening 26 of the upper wall 24 and has an outer tube 27, to which air is supplied from a blower 28 at the top. The lower portion 29 of the tube 27 consists of fireproof material and is constructed with passages 30 for injecting air into the combustion chamber in a downwardly and outwardly inclined direction. Inside the outer tube there is provided an intermediary tube 31 for conducting surplus air to an outlet tube 32 provided at the top of the burner unit. In the outlet tube 32 a control throttle is provided by means of which the pressure in the injection passages 30 can be controlled. Both the supplied air and the escaping air serve to cool the barrel burner. The barrel burner also has an inner tube 33 with conduits for the supply of fuel from a fuel pump 34 to a fuel nozzle 35 and for the supply of water to an atomizing nozzle 36. Moreover, the barrel burner is provided with a sensor 37, which is illustrated here in the form of a mechanical sensor connected with a suitable dynamometer. The barrel burner can be displaced from a position above the open top of a barrel standing in the barrel holder practically down to the bottom of the barrel. The sensor 37 serves to test whether the barrel burner on its way into and down through the barrel meets hard or liquid surfaces, and also to test whether the barrel burner in its downward travel reaches the bottom of the barrel as an indication that all waste has been burnt. Instead of a purely mechanical sensor it is possible to use a combined mechanical and thermal sensor, an infrared radiation sensor or other forms of sensors capable of performing the tests described.

The incinerator is moreover provided with measuring equipment, control means, a program unit for automatically controlling the progress of the process.

The operation is as follows:

The number of barrels 1 to be incinerated during a predetermined time interval, e.g., one or more days or maybe a week, are placed in the storage station of the plant comprising the roller conveyor 51.

The plant is started up by means of the burners of the primary combustion chamber 2, 3 and the secondary combustion chamber 64 and is heated by means of these burners to the operation temperature.

From the roller conveyor 51 the foremost barrel 1 is lifted by means of the elevator 10 into the sluice chamber 6 and upon opening of the port 4 the barrel is conveyed by means of the lifting and conveying fork 11 into the barrel holder 14 as previously described, whereafter the lifting and conveying fork 11 is withdrawn and the port 4 is closed.

Owing to the heat radiation from the hot walls of the primary combustion chamber and under the influence of the barrel burner 22 gas and volatile components of the waste contained in the barrel are now expelled and conducted to the secondary combustion chamber for combustion therein.

When the development of gases has been completed, the barrel burner 22 is moved slowly down towards the open top of the barrel. As previously mentioned, the barrel burner is also provided with air injection passages for injecting air at an inclination downwards and outwards. During this downward travel of the barrel burner 22 the surface of the waste is subjected to heat from the flame of the burner, while at the same time combustion air is blown onto the surface, and an intensive combustion is initiated in the surface of the waste material in the barrel. The sensor 37 of the barrel burner is capable of testing whether the surface of the waste is hard as a crust or liquid. The speed of downward travel of the barrel burner 22 and the supply of injected air are controlled partly by this sensing of the nature of the waste, and partly by the combustion temperatures in the secondary combustion 64 chamber and in the primary combustion chamber 2, 3.

If the sensor 37 ascertains that the material in the barrel is a liquid, the barrel burner 22 continues to travel downwards in time with the combustion of the liquid until the waste in the barrel is completely burnt away and the bottom has been reached. Thereafter the barrel burner 22 is moved back to its top position whereafter, if deemed necessary, the barrel is turned 180° by means of the barrel holder in order to pour out any ashes, and then the barrel is turned back to upright position. The port 4 is opened and the lifting and conveying fork 11 is pushed in under the empty barrel standing in the barrel holder 14 and is then withdrawn to retract the barrel through the port 4 which is then again closed. The lifting and conveying fork deposes the empty barrel on the pallet 9 and the elevator 10 now lowers the empty barrel down onto a roller conveyor 52 for receiving and removing the empty barrels.

If, on the other hand, the sensor 37 ascertains that the waste in the barrel is of hard consistency, the barrel burner 22 is immediately moved back to its top position and thereafter the barrel holder 14 is turned slowly around its axis of rotation. Under the influence of the oil burners in the walls of the combustion chamber, particularly the burners 38 directed downwards and inwards at an inclination, the first waste is burnt free from the inner walls of the barrel. When the barrel holder 14 has turned the barrel 180°, or even before, the contents will drop out down into the bottom section of the combustion chamber which is constructed in conventional manner as a combustion furnace, and the burning of the solid waste is now completed in this part of the incinerator, which may be constructed substantially as described in U.S. Pat. No. 3,670,667.

The barrel holder 14 now again turns the barrel to upright position with the opening at the top, whereafter the barrel burner 22 is again moved down and the sensor 37 tests whether the barrel is in fact empty. If this is not the case, the barrel burner 22 is withdrawn once more and the barrel holder 14 thereafter turns the barrel 180° to inverted position a second time so that the barrel may be completely emptied.

When the barrel burner 22 has ascertained by means of the sensor 37 that the barrel is in fact empty, the barrel is extracted and deposed on the roller conveyor 52 in the same manner as previously described. Thereafter the incinerator is ready for receiving and handling the next barrel in the same manner as described above.

As will be seen, the handling of a barrel takes place in accordance with two alternative sequences of operation, the system automatically choosing one or the other sequence depending on the consistency of the barrel. There also exists the possibility of a combined sequence of operations, e.g., if the waste material in a barrel is liquid at the top, but a hard surface is present further down or is formed during the combustion.

If the situation arises that a barrel gets stuck in the barrel holder 14, the barrel holder may be turned somewhat more than 90° in the direction opposite to that normally used for dropping out the contents, whereby the barrel is caused to slide out of the barrel holder and drop down onto the bottom of the combustion chamber, where it is then burnt.

The construction of the apparatus may be varied in a multitude of ways. As an example fire-proof materials may be used for the barrel holder 14 instead of cooling pipes. The incinerator may in well known manner be provided with a smoke neutralization system and a chimney with a smoke exhaust. Moreover, the incinerator may in well known manner be provided with apparatus for the recovery of waste heat. The incinerator is particularly suitable for installation on the premises of the factory, in which the waste is produced. Thereby external transportation of the barrels is avoided and recovery of waste heat can take place within the factory itself.

If a larger capacity of the incinerator is desired, two or more barrel holders and associated equipment may be mounted side by side. Moreover, the bottom section of the combustion chamber may be so constructed and provided with a separate sluice port in such a manner that the incinerator may alternatively be used for the incineration of other types of waste material or refuse than that mentioned above, according to well-known principles.

I claim:

1. Incinerator for chemical waste material stored in barrels, comprising a primary combustion chamber with an outlet connected to a secondary combustion chamber, characterized in that said primary combustion chamber has a bottom section suitable for the combustion of solid waste material and a top section provided with a lateral port with a sluice closure and associated means for introducing a barrel through said port into said top section and withdrawing it therefrom, a barrel holder being provided in said top section in level with said lateral port, said barrel holder being adapted to receive and hold a barrel introduced through said port and being mounted for rotation about a horizontal axis for the purpose of turning a barrel held by it from upright to fully or partly inverted position and vice versa, burners and air injection means being provided for supplying flame heat and air both to the bottom section of the primary combustion chamber and to the interior of a barrel standing upright in the barrel holder.

2. Incinerator as in claim 1, characterized in that a downwardly directed burner is provided in the top section of the combustion chamber above the location of said holder, said burner being vertically displaceable from a position above the open top of a barrel held in upright position in said holder to a position adjacent the bottom of such barrel, said burner being combined with air injection means for injecting air into the barrel during the lowering of the burner therein, and with a sensor with associated control means adapted upon sensing a hard surface of the contents of the barrel to initiate withdrawal of the displaceable burner from the barrel and subsequent turning of the barrel held in the holder from upright position to fully or partly inverted position.

3. Incinerator as in claim 1 or 2, characterized in that the barrel holder is constructed in the form of a cage formed by cooling pipes which through an opening in the combustion chamber wall, fitted with a sealing member, are connected with a hub member rotatably mounted outside the combustion chamber.

4. Incinerator as in claims 1 or 2, characterized in that the barrel holder has a configuration assymmetric with respect to its axis of rotation in such a manner that a barrel held in the holder is detained from sliding out of the holder when turned in one direction from upright position towards inverted position, but is free to slide out of the holder when turned in the opposite direction from upright position towards inverted position.

* * * * *